United States Patent [19]

Mizukura et al.

[11] Patent Number: 4,460,682

[45] Date of Patent: Jul. 17, 1984

[54] SILVER HALIDE PHOTOGRAPHIC ELEMENT

[75] Inventors: Noboru Mizukura, Tsukui; Satoru Ikeuchi, Hino; Shunji Suginaka; Noriko Fujita, both of Tokyo, all of Japan

[73] Assignee: Konishiroku Photo Industry Co., Ltd., Tokyo, Japan

[21] Appl. No.: 449,849

[22] Filed: Dec. 15, 1982

[30] Foreign Application Priority Data

Dec. 19, 1981 [JP] Japan ..... 56-205525

[51] Int. Cl.[3] ..... G03C 1/06; G03C 1/48

[52] U.S. Cl. ..... 430/559; 430/955; 430/936; 430/233; 430/212; 430/218; 430/219; 430/447; 430/542; 430/564; 430/566; 430/612; 430/621; 430/570; 430/551; 430/546

[58] Field of Search ..... 430/223, 955, 936, 559, 430/212, 218, 219, 447, 542, 564, 566, 612, 621, 570, 551, 546

[56] References Cited

U.S. PATENT DOCUMENTS 4,183,754 1/1980 Chapman et al. ..... 430/936

*Primary Examiner*—Won H. Louie, Jr.

*Attorney, Agent, or Firm*—Finnegan, Henderson, Farabow, Garrett & Dunner

[57] ABSTRACT

A novel silver halide photographic element which contains a nondiffusible complex capable of releasing a diffusible, photographically useful material is disclosed.

Said nondiffusible complex becomes active for ligand exchange upon reduction under alkalin conditions to release a diffusible, photographically useful material, said complex being represented by the following formula:

$$[Co(III)\,(La)\,(Lb)]Y_r$$

BALL PHOTO wherein La is a quadridentate ligand group; Lb is a didentate ligand group; BALL is a ballast group; PHOTO is a photographically useful material group; Y is a counter ion; and r is the number of counter ions necessary for neutralizing the electric charge on the CO(III) complex.

12 Claims, No Drawings

SILVER HALIDE PHOTOGRAPHIC ELEMENT

FIELD OF THE INVENTION

The present invention relates to a new silver halide photographic element. More particularly, the invention relates to a new silver halide photographic element that contains a nondiffusible complex capable of releasing a diffusible, photographically useful material.

BACKGROUND OF THE INVENTION

Several methods of silver halide photography that forms a color image with a complex are known. The first typical method is the "oxidation-reduction cobalt method" which intensifies a color image by using the oxidizing power of a Co(III) complex. In the exposed area, the Co(III) complex reacts with a color developing agent in the presence of a silver image catalyst to form a dye in amounts larger than is formed in the ordinary reaction.

The second method is the "cobalt complex photography" which uses a photo-reducing agent that is formed upon exposure and reduces the Co(III) complex to a Co(II) complex and a silver halide photographic element comprising the Co(III) complex. In the cobalt complex photography described in Japanese Patent Applications (OPI) Nos. 139722/75, 139723/75 and 139724/75 (the symbol OPI as used herein means an unexamined published Japanese patent application), the Co(III) complex is reduced in the exposed area to form a Co(II) ion and ammonia. The method uses a system that forms an image with the aid of (1) the Co(II) ion and (2) released ammonia in the exposed area or (3) the remaining Co(III) complex in the unexposed area.

Two methods are known which form an image using the ligand of a complex. One of them uses a pyrylium dye or the like that upon contact with ammonia changes its color and turns to a substantially transparent type, and the other method uses phthalaldehyde or ninhydrin that is printed out upon contact with ammonia. But this system is a thermal process that requires heat (typically 85° to 150° C.) for accelerating the reduction of the complex and evaporating the ligand to form an image on a recording element. Therefore, this system is not suitable for processing at ordinary temperatures.

The third metal uses a dye metal composite as disclosed in Japanese Patent Publication No. 7872/60. The disclosed complex is such that it provides a dye that is insoluble in an alkali, which is reducible with a silver halide developing agent and which is soluble in an alkali acting composition. The reference lists a copper complex of o,o'-dihydroxyazo dye as one example. Such metal dye composite is what is called a metal chelate dye wherein the dye is directly coordinated to the central metal atom, so only dyes that have a number of chelatable groups can form stable metal complexes. Furthermore, the metal complexes listed in Japanese Patent Publication 7872/60 have dye-containing ligands that become active for exchange in an unreduced state, and if they are employed as image-forming materials in combination with silver halide emulsions, even the unexposed area develops a color to foul the final image.

Japanese Patent Application No. 183573/80 discloses a silver halide photographic element that contains a nondiffusible ligand exchange inactive complex that is reduced under alkaline conditions to become active for ligand exchange and release a diffusible, photographically useful material. But upon reduction in alkaline conditions, the nondiffusible ligand exchange inactive complex becomes active for ligand exchange to release not only the diffusible, photographically useful material but also the complex metal ion. The released metal ion has adverse effects on the diffusibility of the photographically useful material, as well as on the silver halide emulsion.

SUMMARY OF THE INVENTION

One object of the present invention is to provide a silver halide photographic element that contains a nondiffusible complex capable of releasing a diffusible, photographically useful material.

Another object of the invention is to provide a silver halide photographic element that contains a nondiffusible complex that is capable of releasing a diffusible, photographically useful material and which is stable in the photographic element.

A further object of the invention is to provide a silver halide photographic element that contains an efficient nondiffusible complex that releases one photographically useful material by at least one electron.

Still another object of the invention is to provide a silver halide photographic element that contains a nondiffusible complex which does not release metal ions upon reduction.

These objects can be accomplished by a silver halide photographic element that contains a nondiffusible ligand exchange inactive complex of the following formula (I) which, being reduced under alkaline conditions, becomes active for ligand exchange to release a diffusible, photographically useful material:

$$[CO^{(III)}(La)\ (Lb)]\ Y_r \qquad \text{Formula (I)}$$

$$\begin{array}{ll} | & | \\ \text{BALL} & \text{PHOTO} \end{array}$$

wherein La is a quadridentate ligand group; Lb is a bidentate ligand group; BALL is a ballast group; PHOTO is a photographically useful material group; Y is a counter ion; and r is the number of counter ions necessary for neutralizing the electric charge on the Co(III) complex. In formula (I), La is preferably a quadridentate ligand having at least two coordinatable nitrogen atoms, and Lb is preferably a bidentate ligand having a ligand selected from among oxygen and nitrogen atoms.

DETAILED DESCRIPTION OF THE INVENTION

The complex of the present invention is nondiffusible under alkaline conditions but it releases a diffusible, photographically useful material when it is placed under alkaline reducing conditions. The mechanism involved in this change is not clear, but probably, the central atom of the complex is reduced by the electron transfer reaction and the ligand exchange inactive complex is changed to a ligand exchange active complex wherein the ligand containing the photographically useful material group can be exchanged faster for other ligands (e.g. aquo molecule), and in consequence, the bond between the central metal and the ligand containing the photographically useful material group is cleaved to permit rapid release of the diffusible, photographically useful material.

One factor responsible for the nondiffusibility of the complex under alkaline conditions is its molecular size, so the photographically useful material becomes diffusible as a result of the cleavage of the bond between the central metal and the useful material. But in the absence of an electron transfer to the complex, the ligand exchange reaction is slow and the ligand containing the photographically useful material group is stable and remains substantially unexchanged in the initial position.

If complexes are classified by their activity and inactivity for ligand exchange, there exists a clear distinction among complexes of the same metal since they often shift between ligand exchange inactive type and active type depending upon the state of oxidation of the metal. Generally, the stability of a complex is increased with the increase in electric charge on the central metal, and in most cases, complexes in a lower state of oxidation are active for ligand exchange whereas those in a higher state of oxidation are inactive. Therefore, complexes which are inactive for ligand exchange may be reduced to the active type of a lower state of oxidation, whereupon ligand exchange occurs to release the ligand having a photographically useful material group. The metal complexes that are reduced to become active for ligand exchange are generally referred to as CLER (metal complex ligand exchange redox) compounds to which the complex of the present invention belongs.

The ligand exchange active complex as used in the present invention is one that has a ligand half life, which is short (not more than 50 seconds), for the ligand coordinated in the complex to decrease when it enters into ligand exchange under alkaline conditions and releases a diffusible, photographically useful material quickly. The ligand exchange inactive complex on the other hand is one that has a relatively long ligand half life (at least 2 minutes) under alkaline conditions and which is substantially free from ligand exchange or causes no such reaction under practical conditions. In the following description, the ligand exchange activity and inactivity, as well as the ligand exchange reaction will simply be referred to as exchange activity and inactivity, and exchange reaction.

The most preferred exchange inactive complex is a Co(III) complex. Most cobalt complexes are much more stable in an oxidized state (III) than in a reduced state (II), so most Co(II) complexes are inactive and will enter into the exchange of a coordinated ligand or a non-coordinated ligand for several days. But the Co(II) complex which is less stable than the Co(III) complex is active for ligand exchange. Therefore, upon reduction, the inactive Co(III) complex turns to the active Co(II) complex which quickly enters into exchange reaction of ligand to release the diffusible, photographically useful material.

The nondiffusible exchange inactive cobalt complex of the present invention comprises a bidentate ligand having the diffusible, photographically useful material group and a quadridentate ligand having the ballast group. The quadridentate ligand having the ballast group forms a stable complex with a divalent cobalt ion produced upon reduction, so it is capable of releasing the diffusible, photographically useful material without releasing the cobalt ion.

The preferred embodiment of formula (I) is represented by the following formula (I)':

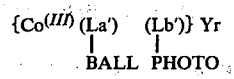

Formula (I)' wherein La' is a quadridentate ligand group having at least two coordinatable nitrogen atoms and is typically derived from the following formula (II) or (III):

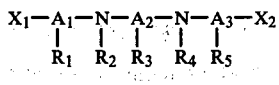

Formula (II)

wherein $X_1$ and $X_2$ which may be the same or different are each

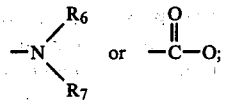

$R_1$ to $R_7$ are each a hydrogen atom, an alkyl group (preferably an alkyl group having 1 to 7 carbon atoms which may have a substituent) or an aryl group (preferably an aryl group having 6 or 7 carbon atoms which may have a substituent), with a hydrogen atom, a methyl or ethyl group being preferred, and $A_1$ to $A_3$ which may be the same or different are each an alkylene group having 1 to 3 carbon atoms which may have an alkyl or aryl group as a substituent, with a methylene, ethylene or propylene group being preferred. The preferred group derived from formula (II) is free from $R_1$, $R_3$ or $R_5$.

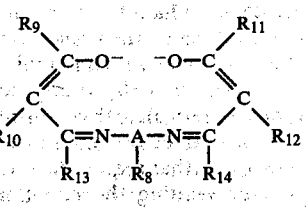

Formula (III)

wherein A is an ethylene or propylene group which may have an alkyl or an aryl group as a substituent; $R_8$ to $R_{14}$ are the same as $R_1$ to $R_7$ of formula (II), respectively; and $R_9$ and $R_{10}$ or $R_{11}$ and $R_{12}$ may form an unsaturated 6-membered ring (e.g. naphthalene ring). The preferred group derived from formula (III) is free from $R_8$.

Examples of the preferred quadridentate ligand group include those derived from (N-N-N-N) type ligands such as triethylenetetramine, 3,7-diazanonane-1,9-diamine and 4,7-diazadecan-1,10-diamine; N-N-N-O) type ligands such as diethylenetriaminemonoacetic acid; and (O-N-N-O) type ligands such as N,N'-ethylenediaminediacetic acid, N,N'-disalicylideneethylenediamine, N,N'-disalicylidenetrimethylenediamine and N,N'-bis(1-methyl-3-oxobutylidene)-thylenediamine. Those derived from triethylenetetramine and diethylenetriaminemonoacetic acid are particularly preferred.

BALL represents a ballast group and is large enough to make the Co(III) complex nondiffusible in the alkali permeable layer of a photographic element. Useful ballast groups are those which have at least 8 to 30 atoms, preferably a substituted or unsubstituted alkyl or aryl group having 14 to 30 carbon atoms.

Lb' represents a bidentate ligand group having a ligand selected from oxygen and nitrogen atoms, and is typically derived from the following formula (IV), (V) or (VI):

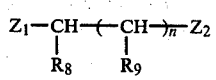

Formula (IV)

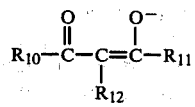

Formula (V)

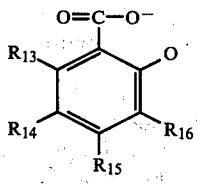

Formula (VI)

wherein $Z_1$ and $Z_2$ which may be the same or different are each

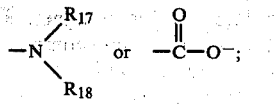

$R_8$, $R_9$, $R_{12}$, $R_{17}$ and $R_{18}$ are each a hydrogen atom, an alkyl group (preferably an alkyl group having 1 to 7 carbon atoms which may have a substituent) or an aryl group (preferably an aryl group having 6 or 7 carbon atoms which may have a substituent), with a hydrogen atom, a methyl, ethyl, phenyl or benzyl group being preferred; $R_{10}$ and $R_{11}$ are each an alkyl group (preferably a substituted or unsubstituted alkyl group having 1 to 7 carbon atoms) or an aryl group (preferably a substituted or unsubstituted aryl group having 6 to 7 carbon atoms), with a methyl, ethyl, trifluoromethyl or phenyl group being preferred; $R_{13}$ to $R_{16}$ are each a hydrogen atom, a halogen atom, a sulfo, cyano, carboxyl, nitro or alkyl group (preferably an alkyl group having 1 to 7 carbon atoms); $R_{12}$ and $R_{13}$, $R_{13}$ and $R_{14}$ or $R_{14}$ and $R_{15}$ may form a saturated ring (i.e., tetrahydronaphthalene ring) or an unsaturated ring (i.e. naphthalene ring); and n is 0 or 1. The preferred group derived from formula (IV), (V) or (VI) is free from $R_8$, $R_{11}$, $R_{12}$ or $R_{15}$.

Preferred examples of the bidentate ligand group include those which are derived from (N-N) type ligands such as ethylenediamine, 1,2-diaminopropane, N-methylethylenediamine, N,N-dimethylenediamine and N,N'-dimethylethylenediamine; (O—O) type ligands such as acetylacetone, benzoylacetone, maloic acid and salicylic acid; and (N—O) type ligands such as glycine and alanine. The groups derived from ethylenediamine, acetylacetone, benzoylacetone, maloic acid and salicylic acid are particularly preferred.

PHOTO represents a photographically useful material group, and illustrative photographically useful materials include a dye, development restrainer, antifoggant, development accelerator, silver halide solvent, developing agent, toning agent, fixing agent, hardener and precursors of these.

Y represents the counter ion of the Co(III) complex. Useful cations are those of alkali metals and quaternary ammonium, and useful anions are a halogen ion, sulfite ion, sulfate ion, alkyl or aryl sulfonate ion, nitrate ion, nitrite ion, perhydrochloride ion, carboxylate ion (e.g. halocarboxylate ion, acetate ion and hexanoate ion), hexafluorophosphate ion, tetrafluoroborate ion and the like.

The symbol r represents the number of counter ions necessary for neutralizing the charges on the Co(III) complex. If La is N,N'-ethylenediaminediacetic acid and Lb is salicylic acid or maloic acid, the Co(III) complex is a monovalent anion, so r is 1 (one) for a monovalent cation such as an alkali metal ion. If La is diethylenetriaminemonoacetic acid and Lb is salicyclic acid or maloic acid, the Co(III) complex has no charge and r is 0 (zero). If La is triethylenetetramine and Lb is salicylic acid or maloic acid, the Co(III) complex is a monovalent cation and r is 1 (one) for a monovalent anion such as a halogen ion, and ½ for a divalent anion such as a sulfate ion. If La is triethylenetetramine and Lb is benzoylacetone, acetylacetone or alanine, the Co(III) complex is a divalent cation, so r is 2 (two) for a divalent cation and 1 (one) for a divalent anion. If La is triethylenetetramine and Lb is ethylenediamine, the Co(III) complex is a trivalent cation, so r is 3 (three) for a monovalent anion and 3/2 for a divalent anion.

When the diffusible, photographically useful material is a development restrainer, an antifoggant or a precursor of each, the respective reagent is selectively released in the undeveloped area to inhibit development or prevent fogging and provides a good image. Typical examples of the development restrainer, are 5-mercaptotetrazoles and benzotriazoles, and typical examples of the antifoggant are azaindenes.

When the diffusible, photographically useful material is a dye or a precursor thereof, the complex of the present invention is very useful as a material to form a dye image for color diffusion transfer process. It releases a diffusible dye or its precursor selectively in the undeveloped area, so by using a negative emulsion as a light-sensitive silver halide emulsion, a positive dye image can be formed on the image-receiving layer. A positive dye image can also be produced by using an internal latent image type direct positive emulsion in a system for making print from a negative film. A positive residual image may be obtained by processing with a positive emulsion, peeling the image-receiving layer, desilvering and fixing.

Suitable dyes are selected from among the dye portions of azo, azomethine, anthraquinone, phthalocyanine and other dye image forming materials conventionally used in the color diffusion transfer process. When the complex of the present invention is used as a dye image forming material, it is preferably positioned in such a manner that the sensitivity of a light-sensitive silver halide emulsion with which it is to be combined will not be decreased. More specifically, if the absorption spectrum of the dye image forming material overlaps that of the silver halide emulsion layer with which it is combined, said material is desirably incorporated in a layer opposite the emulsion layer with respect to the direction of incident light used for exposure. In contrast, if the photographically useful material group contained in the complex of the present invention is a dye precursor group that does not assume the structure of a dye upon exposure but thereafter assumes such structure, the complex may be incorporated in either the silver halide emulsion layer or a layer opposite the emulsion layer with respect to the direction of incident light. Examples of such dye precursor group are leuco dyes that assume a dye structure upon oxidation, as well as shift dyes that change their color due to a change in pH, hydrolysis or formation of a complex with metal ions.

The complex of the present invention is used in an amount generally ranging from $1\times10^{-5}$ to $5\times10^{-3}$ mol/m$^2$, preferably ranging from $1\times10^{-4}$ to $2\times10^{-3}$ mol/m$^2$, and it can be dispersed by any of the known methods, typical examples of which are listed below:

(1) The complex is dissolved in a substantially water-insoluble, high-boiling solvent and then dispersed in fine particles in a hydrophilic protective colloid. Particularly useful high-boiling solvents include N-n-butylacetanilide, diethyllauroylamide, dibutyllauroylamide, dibutyl phthalate, tricresyl phosphate and N-dodecylpyrrolidone. To promote the dissolution of the complex, low-boiling solvent or highly water-soluble organic solvents may be added. Illustrative low-boiling solvents are ethyl acetate, methyl acetate, cyclohexanone, acetone, methanol, ethanol and tetrahydrofuran, and illustrative highly water-soluble organic solvents are 2-methoxyethanol and dimethylformamide. These low-boiling solvents and highly water-soluble organic solvents can be removed by washing with water or drying after coating the complex layer.

(2) To a solution of the nondiffusible dye image forming material in water-miscible organic solvent, a fillable polymer latex and water sufficient to make said image forming material insoluble are added gradually to thereby incorporate the image forming material in the particles of the polymer latex. For details of the water-miscible organic solvent and fillable polymer latex, see Japanese Patent Application (OPI) Nos. 59942/76 and 59943/76;

(3) The complex is reduced to fine particles by mechanical means such as a sand grinder or colloid mill and they are then dispersed in a hydrophilic colloid;

(4) The complex is dissolved in a water-miscible organic solvent, precipitated in water preferably in the presence of a surfactant, and the precipitate is then dispersed in a hydrophilic colloid (see Japanese Patent Application No. 54108/77); and (5) The nondiffusible dye image forming material is dissolved in an aqueous alkaline solution together with a polymer, and the pH of the solution is so adjusted with an acid to precipitate the image forming material, and the precipitate is dispersed in a hydrophilic colloid.

The light-sensitive silver halide emulsion used in the present invention is composed of a colloidal dispersion of silver halide such as silver chloride, silver bromide, silver chlorobromide, silver iodobromide, silver chloroiodobromide and a mixture of these. The silver halide grains may have a wide range of grain size, but the average size ranging from about 0.1 micron to about 2 microns is used with advantage. The silver halide emulsion can be prepared by any known method. An emulsion containing silver halide grains having substantial sensitivity on the surface, as well as an emulsion containing silver halide grains having substantial sensitivity in the interior may be used. The emulsion used in the present invention may be either of negative or direct positive type.

For producing a multi-color dye image, two or more units of combination of the silver halide emulsion layer and the complex containing a dye or its precursor are preferably used, and an intermediate layer is advantageously used between each combination unit. The intermediate layer prevents any undesired interaction from occurring between the combination units and controls the diffusiblity of the diffusible dye or its precursor or an alkaline processing composition.

The silver halide photographic element of the present invention may use any known photographic support which may be transparent or opaque depending on the use. The silver halide photographic element having the photographically useful material in the complex as a dye image forming material is particularly suitable for use in color diffusion transfer process. Among various embodiments of the silver halide photographic element for color diffusion transfer process, a typical product includes successively the first support, an adjacent silver halide emulsion layer combined with the complex containing a dye image forming material, an image receiving layer and the second support as the essential components.

The alkaline processing composition is usually inserted between the first support and the silver halide emulsion layer or between the image receiving layer and the silver halide emulsion layer. The alkaline processing composition contains an alkali agent and a silver halide developing agent. If the silver halide developing agent is incorporated in the first or the second support, the alkaline processing composition need not contain such silver halide developing agnet. The alkaline processing composition is a liquid composition using water as a typical solvent. Suitable examples of the alkali agent are sodium hydroxide, potassium hydroxide and sodium carbonate. The alkaline processing composition preferably has a pH of about 12 or more at room temperatures. Examples of the silver halide developing agent include 3-pyrazolidone compounds such as 1-phenyl-3-pyrazolidone and 1-phenyl-4-hydroxymethyl-4-methyl-3-pyrazolidone, hydroquinone compounds such as hydroquinone and 2-chlorohydroquinone, catechol compounds, amino phenol compounds, and phenylenediamine compounds. The alkaline processing composition may contain a development restrainer such as a triazole compound, or other compounds such as sodium sulfite and potassium bromide. It may also contain a thickener such as hydroxyethyl cellulose.

A neutralizing layer and a timing layer are preferably formed between the first support and the silver halide emulsion layer or between the second support and the image receiving layer. The photographic element of the present invention may further contain various layers (e.g. light reflecting layer, opaque layer and protective layer) and various addenda commonly used in the silver halide photographic element for color diffusion transfer process.

One preferred silver halide photographic element for producing a multi-color dye image by diffusion transfer process includes, in sequence, the following essential layers between two transparent supports: and image receiving layer, a light reflecting layer, an opaque layer, a red-sensitive silver halide emulsion layer combined with a cyan dye image forming material, an intermediate layer, a green-sensitive silver halide emulsion layer combined with a magenta dye image forming material, an intermediate layer, a blue-sensitive silver halide emulsion layer combined with a yellow dye image forming material, a timing layer, and an intermediate layer. Another preferred embodiment includes in sequence, the following essential layers between two opaque supports: a neutralizing layer, a timing layer, a red-sensitive silver halide emulsion layer combined with a cyan dye image forming material, a neutralizing layer, a green-sensitive silver halide emulsion layer combined with a magenta dye image forming material, an intermediate layer, a blue-sensitive silver halide emulsion layer combined with a yellow dye image forming material, a protective layer and an image receiving layer.

Specific examples of the complex of the present invention are listed below, to which the scope of the invention is by no means limited.

List of Illustrative CLER Compounds (1)

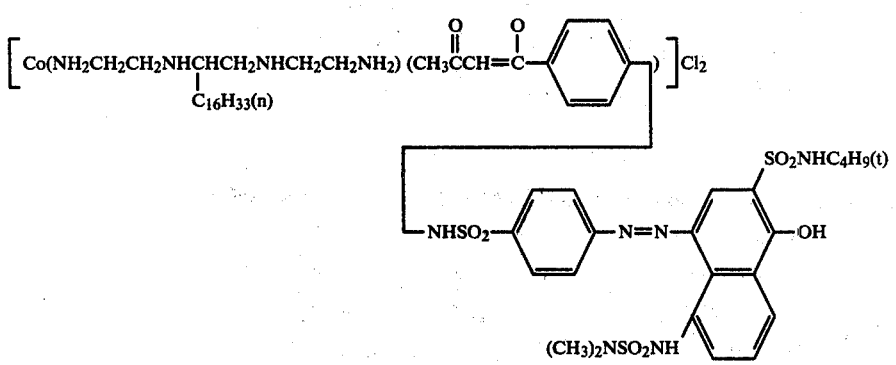

(2)

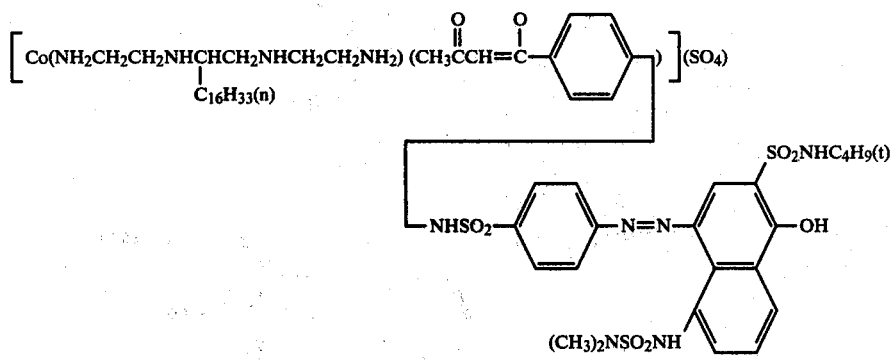

(3)

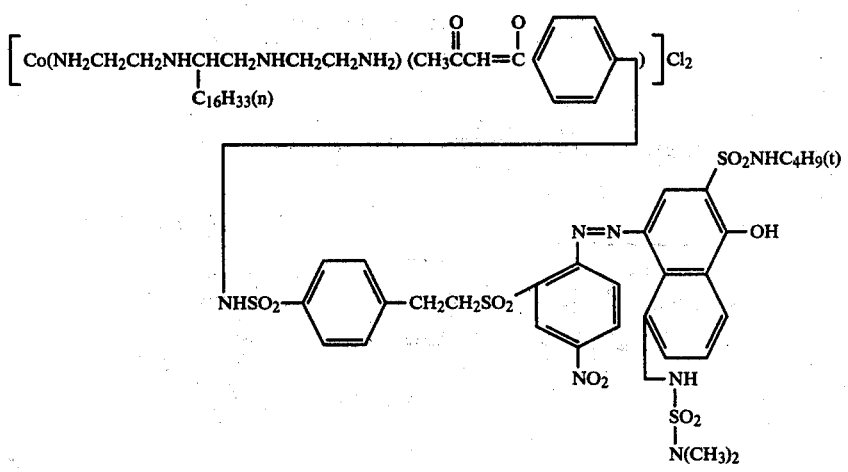

(4)

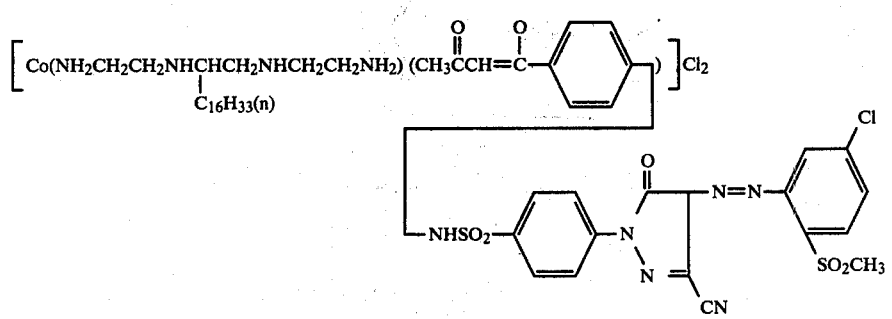

-continued
List of Illustrative CLER Compounds
(5)
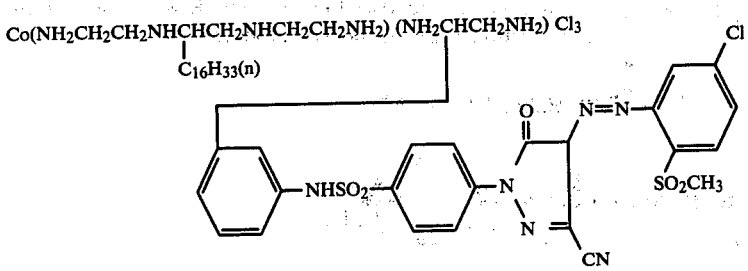
(6)
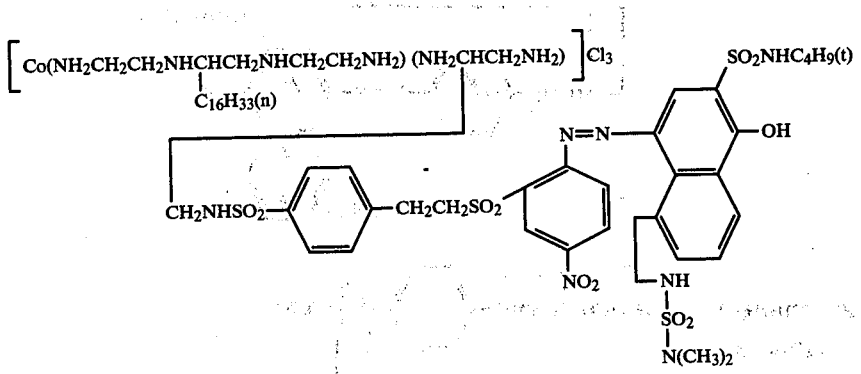
(7)
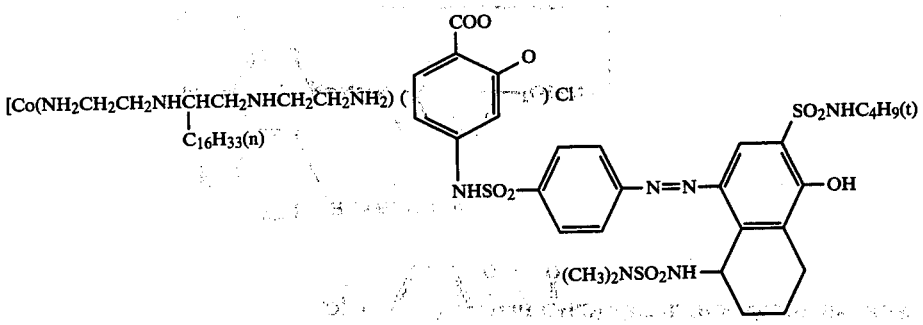
(8)
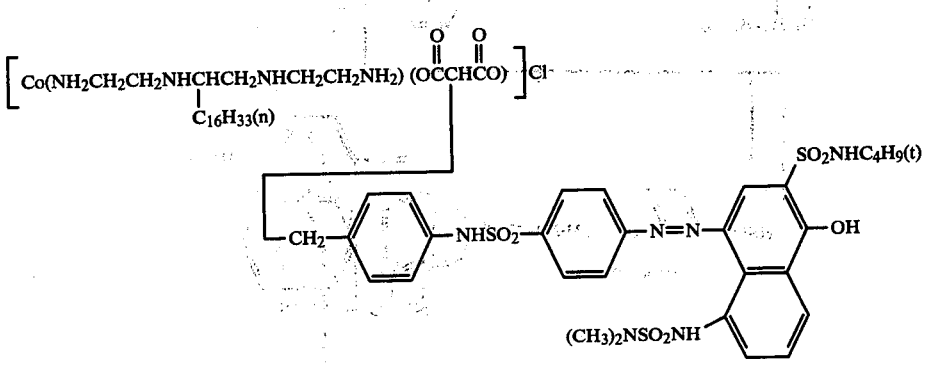
(9)
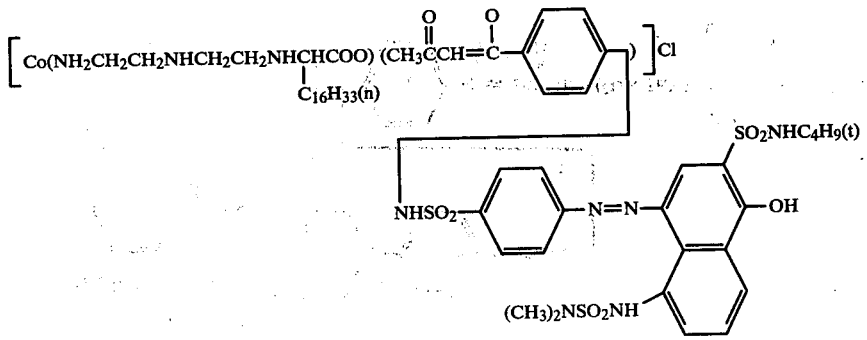

-continued
List of Illustrative CLER Compounds
(10)
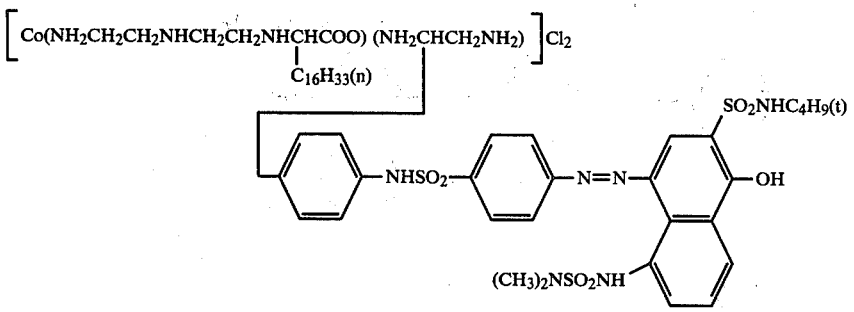
(11)
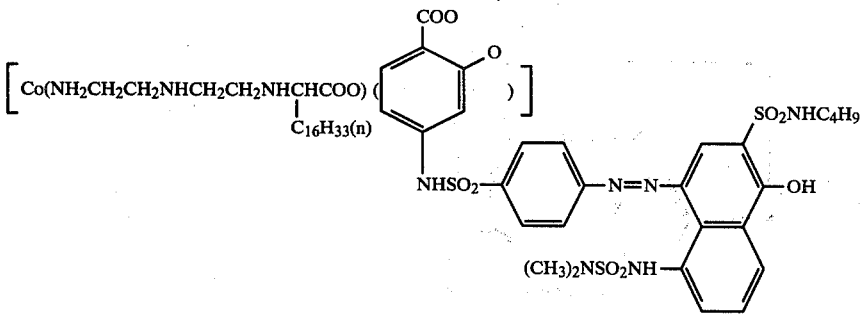
(12)
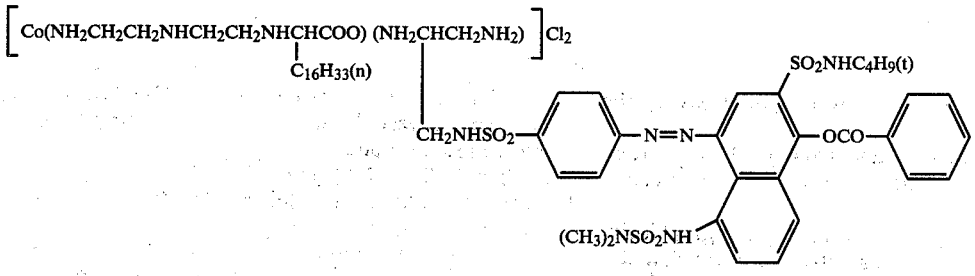
(13)
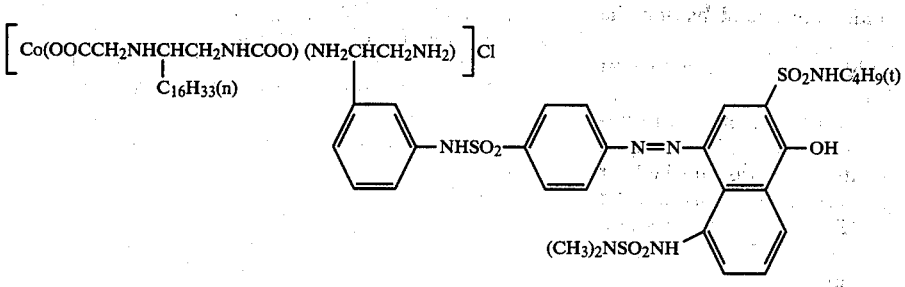
(14)
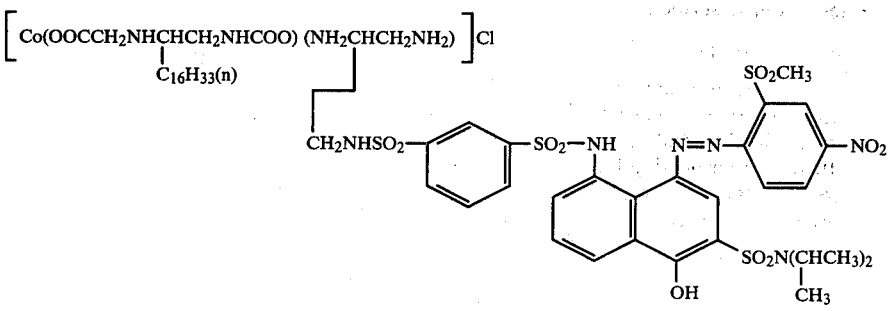

-continued

List of Illustrative CLER Compounds (15)

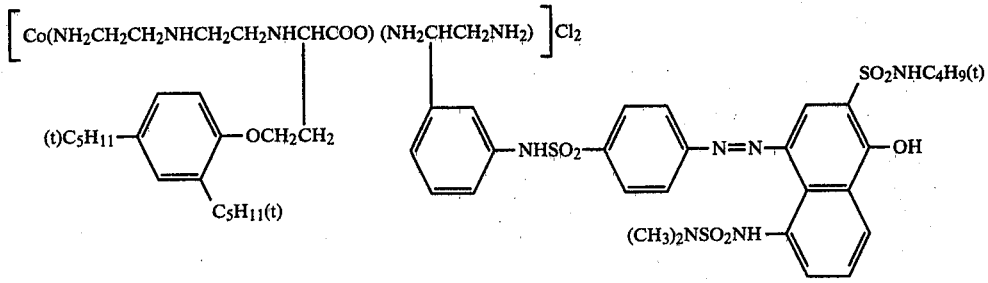

(16)

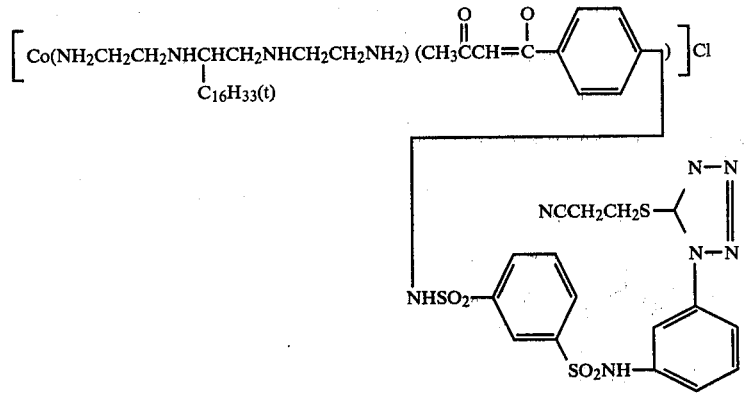

The above listed complexes were synthesized by the following procedure:

(1) A quandridentate ligand having a ballast group was reacted with a cobalt ion to form an intermediate complex;

(2) A bidentate ligand having a photographically useful material group such as a dye was formed; and (3) A CLER compound was formed from the intermediate complex and the bidentate ligand having the photographically useful material group.

The CLER compound could also be prepared by first coodinating a bidentate ligand with a bindable group to the intermediate complex and then reacting the resulting coordination product with sulfonyl chloride (dye). Each of the CLER compounds listed was checked for its structure by electron spin resonance absorption, IR absorption spectrum, and NMR spectrum if necessary. When possible, the melting point of the intermediate was used as confirmatory means.

The specific methods of producing several of the CLER compounds listed are hereunder described.

Synthesis of CLER compound (1)

(1) Preparation of 5-hexadecyltriethylenetetramine

A mixture of 1,2-dibromooctadecane (80 g) and anhydrous ethylenediamine (230 g) was added to 400 ml of ehtanol, and the mixture was refluxed under heating for 10 hours. Then, potassium hydroxide (30 g) was added, and the ethanol was distilled off under reduced pressure. The residue was extracted with 400 ml of benzene and recrystallized from 180 ml of ether to produce a pale yellow product.

Yield: 37.0 g (52%) (m.p. 52°–56° C.)

(2) Preparation of [cis-dichloro(5-hexadecyltriethylenetetramine)cobalt(III)] chloride A solution of cobalt chloride hexahydrate (17.2 g) in methanol (800 ml) was mixed with 5-hexadecyltriethylenetetramine (20.0 g). The mixture was refluxed under heating for 13 hours with air blown that had been passed through an aqueous solution of sodium hydroxide. Then, concentrated hydrochloric acid (40 ml) was added, methanol was distilled off under reduced pressure, and the resulting precipitate was filtered and washed with ether to provide a purple crystal.

Yield: 20.2 g (70%)

(3) Preparation of CLER compound (1)

Cis-[dichloro(5-hexadecyltriethylenetetramine)-cobalt(III)] chloride (5.3 g) was dissolved in ethanol (500 ml) under heating, and 10 ml of 1N aqueous solution of sodium hydroxide was added to the solution which then turned from purple to orange. Compound (A) identified below (7.5 g) was added to the solution, and the mixture was refluxed under heating for 3 hours. Ethanol was distilled off under reduced pressure, and the resulting precipitate was filtered and washed successively with ethanol, water, 0.5N aqueous solution of sodium hydroxide and water.

Yield: 6.8 g (55%)

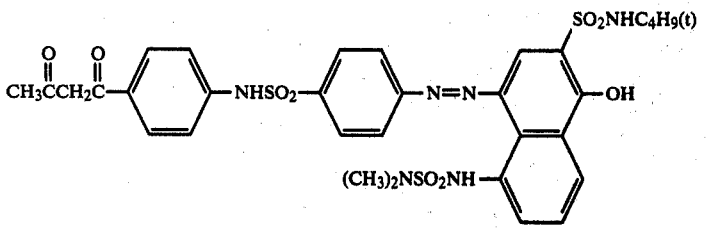

Compound (A)

Synthesis of CLER compound (3)

The titled compound was prepared as in the synthesis of compound (1) from cis-[dichloro(5-hexadecyltriethylenetetramine)cobalt (III) chloride and compound (B) indicated below.

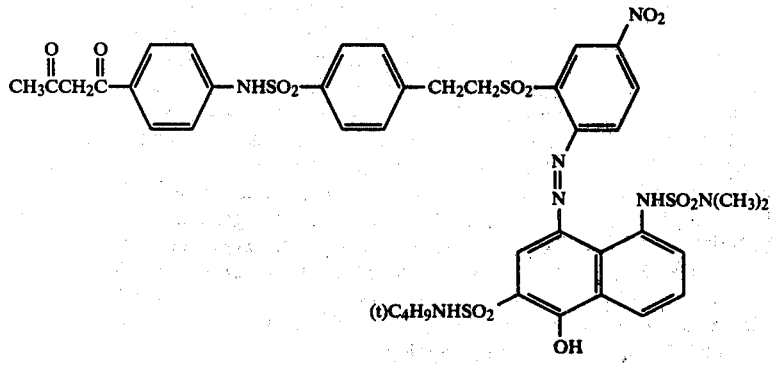

Compound (B)

Synthesis of CLER compound (4)

The titled compound was prepared as in the synthesis of compound (1) from cis-[dichloro(5-hexadecyltriethylenetetramine)cobalt(III)] chloride and compound (C) indicated below.

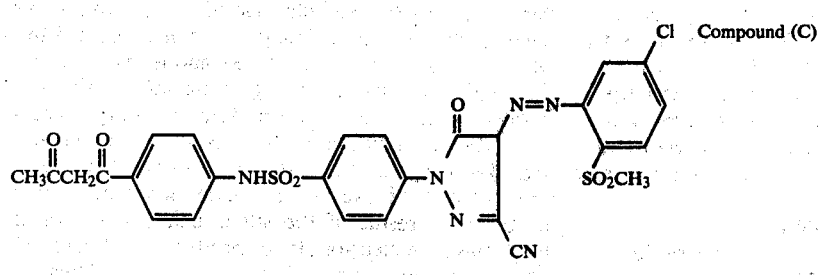

Compound (C)

Synthesis of CLER compound (6)

(1) Preparation of [(5-hexadecyltriethylenetetramine)(1,2,3-triaminopropane)cobalt (III)] chloride Cis-dichloro[(5-hexadecyltriethylenetetramine)-cobalt (III)] chloride (4.8 g) was dissolved in ethanol (500 ml) under heating. To the solution, 1,2,3-triaminopropane hydrochloride (1.6 g) and 1N aqueous solution of sodium hydroxide were added, and the mixture was refluxed for 2 hours, whereupon the reaction liquor turned from purple to orange. The reaction liquor was filtered and the filtrate was distilled off under vacuum. The residue was washed with ether to produce an orange solid product.

Yield: 4.7 g (84%)

(2) Preparation of CLER compound (6)

[(5-hexadecyltriethylenetetramine) (1,2,3-triminopropane)cobalt (III)] chloride (5.2 g) was dissolved in chloroform (400 ml), and triethylamine (13.2 ml) was added to the solution. Then, 5.0 g of compound (D) indicated below was added in small portions at room temperature. The mixture was stirred for one hour at room temperature and refluxed for 30 minutes. Chloroform was distilled off under vacuum, and the residue was dissolved in 50 ml of dimethylformamide, and the insoluble matter was filtered. The filtrate (dimethylformamide solution) was added to 10% sodium bicarbonate, and the resulting precipitate was filtered and washed with water and methanol in this order.

Yield: 5.8 g (58%)

Compound (D)

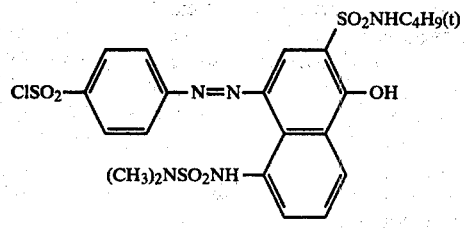

Synthesis of CLER compound (7)

Cis-[dichloro(5-hexadecyltriethylenetetramine)-cobalt (III)] chloride (5.3 g) was dissolved in 500 ml of ethanol under heating. To the solution, 1N ammonia water (10 ml) was added, when the solution turned purple to orange. Then, 7.1 g of compound (E) indicated below and 10 ml of 1N aqueous solution of sodium hydroxide were added to the solution, which was refluxed under heating for 3 hours. Thereafter, ethanol was distilled off under reduced pressure, and the resulting crystal was filtered and washed successively with ethanol, water, 0.1N aqueous solution of sodium hydroxide and water.

Yield: 5.2 g (43%)

Compound (E)

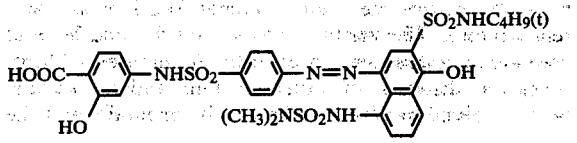

Synthesis of CLER compound (9)

(1) Preparation of 2-bromostearic acid

Stearic acid (42.6 g) was heated in an oil bath to 90° C. until it melted. Phosphorus trichloride (0.6 ml) was added to the melt while bromide (8.5 ml) was added dropwise over 3 hours under stirring. Another portion (7.7 ml) of bromine was added dropwise over 2.5 hours, and thereafter the mixture was heated at 90° C. for 3.5 hours. The reaction mixture was cooled, followed by the addition of 200 ml of carbon tetrachloride and 100 ml of water. The organic layer was dried with anhydrous sodium sulfate and the solvent was distilled off under vacuum to give a yellow oily substance. The substance was dissolved in 60 ml of ethanol under heating, then the solution was cooled to produce a pale yellow solid product.

Yield: 33.7 g (62%) (m.p. 60°-62° C.)

(2) Preparation of 2-hexadecyldiethylenetriaminemonoacetic acid 2-Bromostearic acid (33.7 g) was dissolved in ehtanol (150 ml) under heating, and to the solution, diethylenetriamine (30.0 g) was added under stirring. The solution was mixed with 16 g of 30% aqueous solution of sodium hydroxide and the mixture was refluxed for 6 hours. The mixture was cooled and the resulting precipitate was filtered and washed with 200 ml of methanol to provide a white solid product.

Yield: 17.5 g (49%) (m.p. 63°-66° C.)

(3) Preparation of dinitro(2-hexadecyldiethylenetriaminemonoacetic acid)cobalt (III)

A solution of cobalt chloride hexahydrate (10.8 g) in 200 ml of methanol was mixed with a solution of sodium nitrite (7.8 g) in 20 ml of water. To the solution being bubbled with air, a solution of 2-hexadecyldiethylenetriaminemonoacetic acid (17.5 g) and sodium hydroxide (2.0 g) in methanol (250 ml) and acetic acid (2.8 g) were added gradually. After air bubbling for 3 hours at 40° C., the solution was cooled and the resulting yellow precipitate was filtered.

Yield: 10.5 g (43%)

(4) Preparation of dichloro(2-hexadecyldiethylenetriaminemonoacetic acid)cobalt (III)

Dinitro(2-hexadecyldiethylenetriaminemonoacetic acid)cobalt (III) (10.0 g) was dispersed in ethanol (200 ml) under heating, and after addition of concentrated hydrochloric acid (20 ml), the mixture was heated at 70° C. for 6 hours. The resulting green precipitate was cooled, filtered and washed with methanol.

Yield: 4.6 g (48%)

(5) Preparation of CLER compound (9)

Dichloro(2-hexadecyldiethylenetriaminemonoacetic acid)cobalt (III) (4.0 g) was dissolved in ethanol (500 ml) under heating, and 1N aqueous solution of sodium hydroxide (8 ml) was added to the ethanol solution, which then turned from green to yellow. CLER compound (I) (5.4 g) was added to the solution and the mixture was refluxed for 3 hours, and ethanol was distilled off under vacuum. The resulting precipitate was filtered and washed successively with ethanol, water, 0.5N aqueous solution of sodium hydroxide and water.

Yield: 5.2 g (55%)

The complex of the present invention is reduced with an electron donor. Any compound whether it is capable of developing silver halide or not can be used as the electron donor so long as it has the ability to reduce the complex. Preferred electron donors are those which have a half life of up to 30 minutes as a measure of the rate of redox reaction with the complex under the processing conditions of the silver halide photographic element. If the silver halide developing agent is used as an electron donor, the donor is oxidized as a result of development of silver halide and no longer acts as an electron donor. Pursuant to the reduction of the complex by the electron donor remaining in the undeveloped area, the diffusible, photographically useful material is released from the complex. The preferred electron donor has a half life in the redox reaction with the exposed silver halide five to ten times shorter than the half life in the redox reaction with the complex of the present invention.

Typical electron donors that also serve as the silver halide developing agent include ascorbic acid, hydroxylamines such as diethylhydroxylamine, and trihydroxypurimidines such as 2-methyl-4,5,6-trihydroxypurimidine. Electron donors which have no or only weak ability to develop silver halide can also be used as precursors that provide an electron donor upon hydrolysis. Such precursors include lactones, hydroquinones wherein at least one hydroxyl group is protected by a hydrolyzable group, pyrazolones, and isooxazolones.

The electron donors having no or only weak ability to develop silver halide are preferably incorporated in the silver halide photographic element in combination with the complex of the present invention. The oxidation product of the silver halide developing agent formed as a result of the silver halide development reacts with the electron donor produced by hydrolysis, whereupon the electron donor is oxidized. Then, the complex is reduced by the remaining electron donor to release the diffusible, photographically useful material.

The preferred silver halide developing agent has a half life in the redox reaction with the complex of the present invention five to ten times longer than the half life in the redox reaction between said complex and the electron donor. Useful developing agents include hydroquinone compounds such as hydroquinone, 2,5-dichlorohydroquinone and 2-chlorohydroquinone; aminophenolic compounds such as 4-aminophenol, N-methylaminophenol, 3-methyl-4-aminophenol and 3,5-dibromoaminophenol; catechol compounds such as catechol, 4-cyclohexylcatechol, 3-methoxycatechol and 4-(N-octadecylamino)catechol; and phenylenediamine compounds such as N,N-diethyl-p-phenylenediamine, 3-methyl-N,N-diethyl-p-phenylenediamine, 3-methoxy-N-ethyl-N-ethoxy-p-phenylenediamine and N,N,N',N'-tetramethyl-p-phenylenediamine. Particularly preferred are 3-pyrazolidone compounds such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-purazolidone, 1-p-tolyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-purazolidone, 1-(3-tolyl)-4,4-dimethyl-3-pyrazolidone, 1-(2-trifluoroethyl)-4,4-dimethyl-3-purazolidone and 5-methyl-pyrazolidone. Two or more developing agents may be combined as disclosed in U.S. Pat. No. 3,039,869. Such developing agents may be used in the processing composition, or at least part of them may be incorporated in one or more optional layers of the silver halide photographic element, such as silver halide emulsion layers, dye image forming material layers, intermediate layers and the image receiving layer.

In the present invention, the electron donor (as well as its precursors) is preferably used in the silver halide photographic element in an amount 0.5 to 6 times that of the complex defined hereinabove. Isooxazolones which are preferred as hydrolyzable electron donors are represented by the following formula:

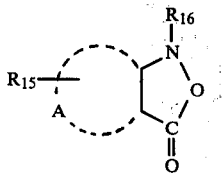

wherein A represents a group containing atoms necessary for forming an aromatic ring of 5 or 6 carbon atoms together with the remainder of the formula noted above, and preferably A is an aromatic hydrocarbon ring; $R_{15}$ is a hydrogen atom or a ballast group that contains 1 to 30 carbon atoms and which preferably renders the isooxazolones nondiffusible within the silver halide photographic element, said ballast group being, for example, a group cintaining 8 to 30 carbon atoms, more specifically an N-substituted carbamoyl group such as N-alkylcarbamoyl, alkylthioether group, N-substituted sulfamoyl group such as N-alkylsulfamoyl, or alkoxycarbonyl group; and $R_{16}$ is an alkyl group having 1 to 30 carbon atoms or an aryl group having 6 to 30 carbon atoms, preferably a methyl group. Typical electron donors included within this definition are listed below.

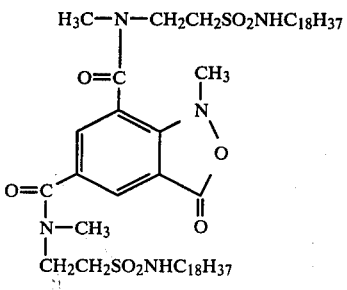

-continued

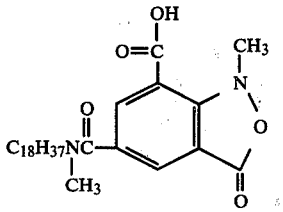

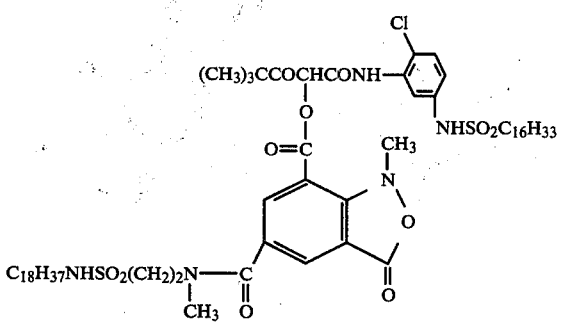

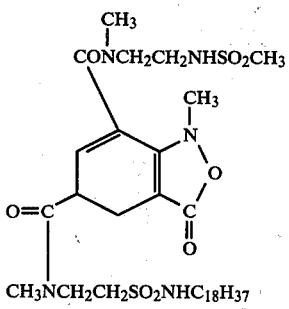

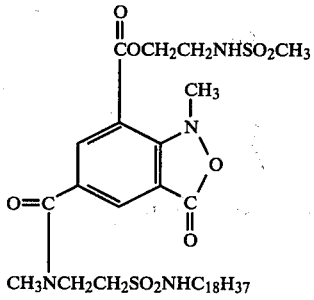

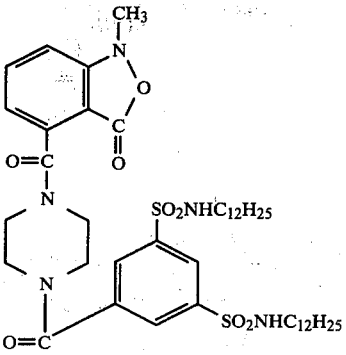

-continued
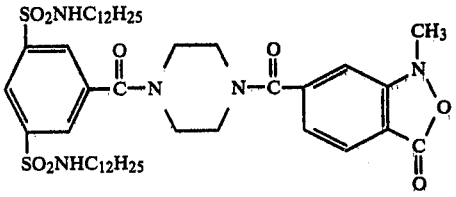
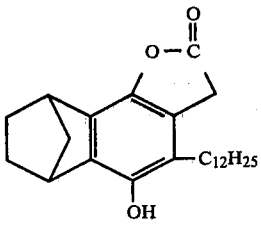
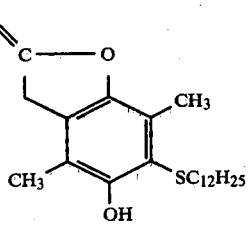
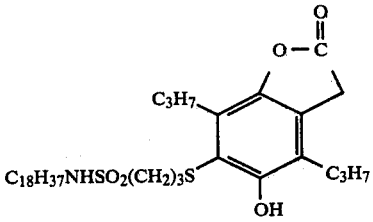
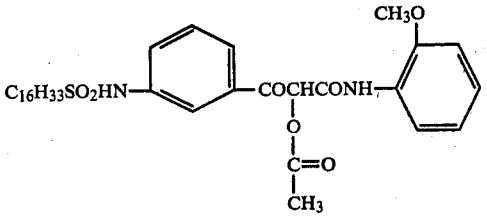
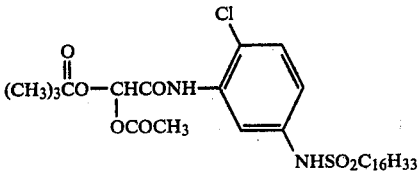
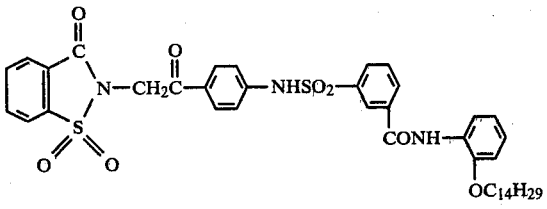
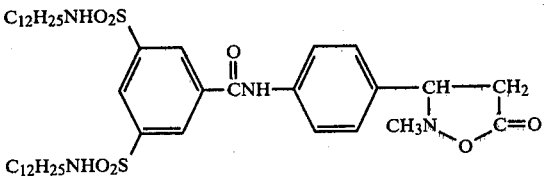
-continued
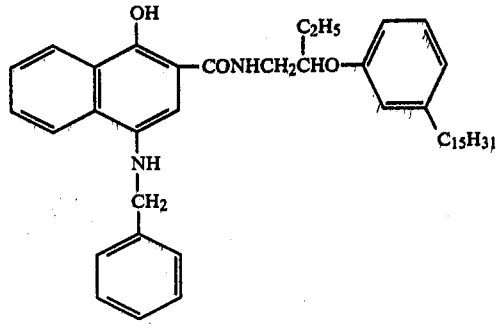
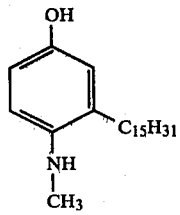
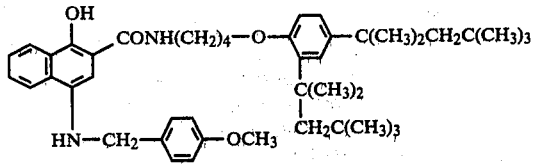
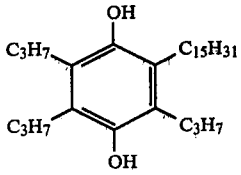
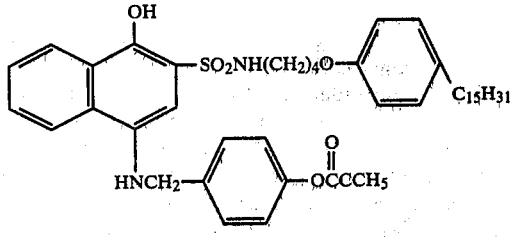
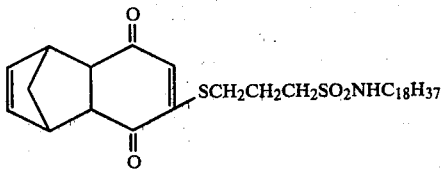
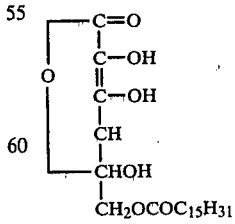
The silver halide photographic element using the complex of the present invention is now described in greater detail by reference to the following examples which are given here for illustrative purposes only and are by no means intended to limit the scope of the invention.

EXAMPLE 1

Preparation of a multi-layer, monochromatic photosensitive element:

A multi-layer, monochromatic photosensitive element was prepared by coating, in sequence, the following layers on a transparent polyethylene terephthalate film support 150 μm thick:

(1) an image receiving layer containing 2.7 g/m² each of gelatin and poly(styrene-co-N-benzyl-N,N-dimethyl-N-methacryloylaminophenylmethylammoniumchloride-co-divinylbenzene) (molar ratio=48:48:4);

(2) a light reflecting layer containing titanium dioxide (22 g/m²) and gelatin (2.2 g/m²);

(3) an opaque layer containing carbon black (2.8 g/m²) and gelatin (1.8 g/m²);

(4) a magenta dye image forming material layer containing magenta CLER compound (1) (0.44 g/m²), benzisooxazolone electron donor (0.37 g/m²), N,N-diethylaurylamine (1.1 g/m²) and gelatin (2.5 g/m²);

(5) a green-sensitive emulsion layer containing a green-sensitive silver iodobromide emulsion (0.76 g/m² in terms of silver) and gelatin (1.15 g/m²);

(6) a protective layer containing mucochloric acid (100 mg/m²) and gelatin (1 g/m²).

A processing sheet was then prepared by coating, in sequence, the following layers on a transparent polyethylene terephthalate film support 100 μm thick;

(1) a neutralizing layer containing an acrylic acid/butyl acrylate (75/25 wt%) copolymer (22 g/m²);

(2) a timing layer containing a mixture (5 g/m²) of 95% diacetyl cellulose (degree of acetylation: 40%) and 5% poly(styrenemaleic anhydride) copolymer; and (3) an underlying timing layer containing poly(vinylidene chloride-co-acrylonitrile-co-acrylic acid) (79/15/6 wt%) (1.1 g/m²).

The multi-layer monochromatic photosensitive element was given a predetermined exposure through a 30-step optical silver wedge (density difference between each step: 0.15), and thereafter, the processing sheet was superimposed on the exposed photosensitive element. A pod containing about 1.0 ml of a processing composition of the formulation indicated below was then inserted between the processing sheet and the photosensitive element to make a film unit, which was then passed between a pair of pressure rollers with a clearance of about 340 μm. The pod burst and the processing composition spread between the photosensitive element and the processing sheet.

| Formulation of the processing composition | |
|---|---|
| Sodium hydroxide | 56 g |
| Sodium sulfite | 2.0 g |
| 4-Hydroxymethyl-4-methyl-1-phenyl-3-pyrazolidone | 8.0 g |
| 5-Methylbenzotriazole | 2.8 g |

Several minutes later, a positive magenta dye image could be viewed through the transparent support of the photosensitive element. The reflection density of the image was measured with a Sakura photoelectric densitometer Model FIA-60 of Konishiroku Photo Industry Co., Ltd. using a green filter (λmax=554 nm). The result: Dmax=1.87, Dmin=0.25.

EXAMPLE 2

A positive cyan dye image was produced by repeating Example 1 except that magenta CLER compound (1) was replaced by cyan CLER compound (6). The reflection density of the image was measured using a red filter (λmax=664 nm). The result was: Dmax=1.72, Dmin=0.24.

EXAMPLE 3

A positive magenta dye image was produced by repeating Example 1 except that magenta CLER compound (1) was replaced by magenta CLER compound (7). The result of the measurement of the reflection density was: Dmax=1.83, Dmin=0.26.

EXAMPLE 4

Using the film units prepared in Examples 1 and 3, the image transfer speed (the time required for 80% of the maximum transfer density to be transferred) was measured. The results are indicated in Table 1.

TABLE 1

| | CLER comp. (1) | CLER comp. (7) | control CLER com. (A) | control CLER comp. (B) |
|---|---|---|---|---|
| Transfer speed (min) | 3,5 | 3.4 | 4.2 | 4.0 |

The above data shows that the CLER compounds of the present invention achieved faster image transfer than the control CLER compounds.

Control CLER compounds (A)

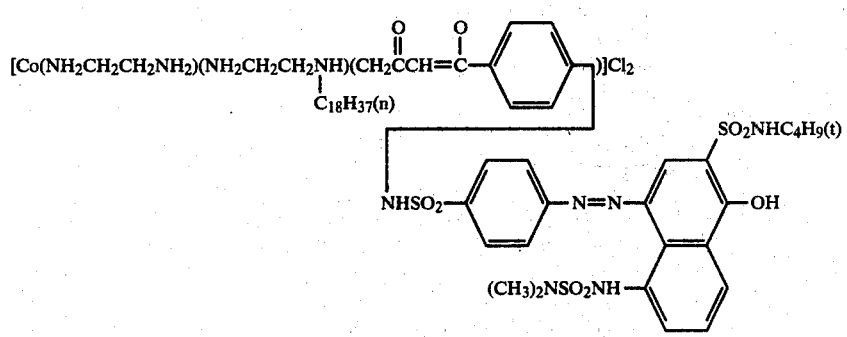

-continued (B)

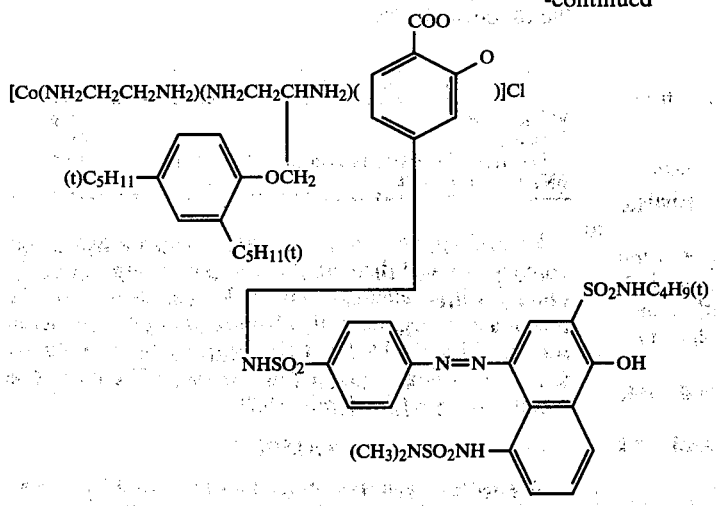

EXAMPLE 5

A multi-layer, multi-color photosensitive element was prepared by coating, in sequence, the following layers on a transparent polyethylene terephthalate film support 150 μm thick:

(1) an image receiving layer containing 2.7 g/m$^2$ each of gelatin and poly(styrene-co-N-benzyl-N,N-dimethyl-N-methacryloylaminophenylmethylammoniumchloride-co-divinylbenzene) (molar ratio=48:48:4);

(2) a light reflecting layer containing titanium dioxide (22 g/m$^2$) and gelatin (2.2 g/m$^2$);

(3) an opaque layer containing carbon black (2.8 g/m$^2$) and gelatin (1.8 g/m$^2$);

(4) a cyan dye image forming material layer containing cyan CLER compound (3) (0.35 g/m$^2$), benzisooxazolone electron donor (0.26 g/m$^2$), N,N-diethylaurylamine (1.1 g/m$^2$) and gelatin (2.5 g/m$^2$);

(5) a red-sensitive emulsion layer containing a red-sensitive silver iodobromide emulsion (0.53 g/m$^2$ in terms of silver) and gelatin (0.90 g/m$^2$);

(6) an intermediate layer containing 2-acetyl-5-sec-octadecylhydroquinone (0.45 g/m$^2$), dibutyl phthalate (0.225 g/m$^2$) and gelatin (1.0 g/m$^2$);

(7) a magenta dye image forming material layer containing magenta CLER compound (1) (0.45 g/m$^2$), benzisooxazolone electron donor (0.37 g/m$^2$), diethylaurylamide (1.1 g/m$^2$) and gelatin (2.5 g/m$^2$);

(8) a green-sensitive emulsion layer containing a green-sensitive silver iodobromide emulsion (0.76 g/m$^2$ in terms of silver) and gelatin (1.15 g/m$^2$);

(9) an intermediate layer containing 2-acetyl-5-sec-octadecylhydroquinone (0.45 g/m$^2$), dibutyl phthalate (0.225 g/m$^2$) and gelatin (0.10 g/m$^2$);

(10) a yellow dye image forming material layer containing yellow CELR compound (4) (0.50 g/m$^2$), benzisooxazolone electron donor (0.47 g/m$^2$), N,N-diethylaurylamide (1.1 g/m$^2$) and gelatin (2.5 g/m$^2$);

(11) a blue-sensitive emulsion layer containing a blue-sensitive silver iodobromide emulsion (0.97 g/m$^2$ in terms of silver) and gelatin (1.50 g/m$^2$); and

(12) a protective layer containing tetraquis(vinylsulfonylmethyl)methane (0.2 g/m$^2$) and gelatin (0.9 g/m$^2$).

The so prepared photosensitive element was given a predetermined exposure through a silver wedge and a processing sheet the same as that used in Example 1 was superimposed on the exposed photosensitive element. A pod containing a processing composition the same as used in Example 1 was inserted between the processing sheet and the photosensitive element to make a film unit, which was passed between a pair of pressure rollers. The pod ruptured and the processing composition spread between the photosensitive element and the processing sheet. Fifteen minutes later, the reflection densities against red, green and blue lights were measured, and the results are shown in Table 2 below.

TABLE 2

| | Light | | |
|---|---|---|---|
| Test area | Red | Green | Blue |
| Exposed | 0.22 | 0.26 | 0.29 |
| Unexposed | 1.79 | 1.75 | 1.91 |

What is claimed is:

1. A silver halide photographic element containing a non-diffusible, ligand exchange active complex which when reduced under alkaline conditions becomes active for ligand exchange to release a diffusible, photographically useful material, said ligand exchange active complex having the formula:

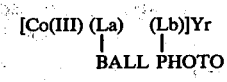

wherein La is a quadridentate ligand group having at least two coordinatable nitrogen atoms; Lb is a bidentate ligand group selected from among oxygen and nitrogen atoms; BALL is a ballast group; PHOTO is a photographically useful material group; Y is a counter ion; and r is the number of counter ions necessary for neutralizing the electric charge on the Co(III) complex.

2. A silver halide photographic element according to claim 1, wherein said complex is reduced by an electron donor or a precursor thereof.

3. A silver halide photographic element according to claim 1, wherein the alkaline conditions are such that the pH is more than 12.

4. A silver halide photographic element according to claim 1, wherein said quadridentate ligand is a group remaining after removal of either one of the groups $X_1$, $X_2$, $R_1$, $R_2$, $R_3$, $R_4$ and $R_5$ of the following formula (II):

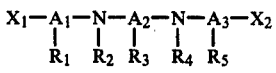

wherein $X_1$ and $X_2$ which may be the same or different are each

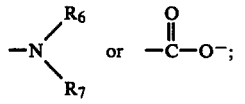

$R_1$ to $R_7$ are each a hydrogen atom, an alkyl group or an aryl group; and $A_1$ to $A_3$ which may be the same or different are each an alkylene group selected from the group consisting of methylene, ethylene and propylene groups each of which may have an alkyl or aryl group as a substituent.

5. A silver halide photographic element according to claim 4, wherein said quadridentate ligand is a group remaining after removal of either one of the groups $R_9$ to $R_{12}$ of the following formula (III):

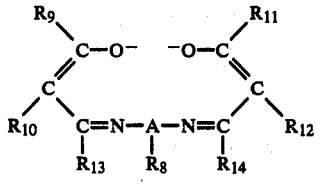

wherein A is an ethylene or propylene group which may have an alkyl or aryl group as a substituent; and $R_8$ to $R_{14}$ are the same as $R_1$ to $R_7$ of formula (II), respectively and $R_9$ and $R_{10}$ or $R_{11}$ and $R_{12}$ may form an unsaturated 6-membered ring.

6. A silver halide photographic element according to claim 1, wherein said quadridentate ligand is selected from among those derived from (N-N-N-N) type ligands such as triethylenetetramine, 3,7-diazanonane-1,9-diamine and 4,7-diazadecan-1,10-diamine; (N-N-N-O) type ligands such as diethylenetriaminemonoacetic acid; and (O-N-N-O) type ligands such as N,N'-ethylenediaminediacetic acid, N,N'-disalicylideneethylenediamine, N,N'-disalicylidenetrimethylenediamine and N,N'-bis(1-methyl-3-oxobutylidene)ethylenediamine.

7. A silver halide photographic element according to claim 1, wherein said bidentate ligand is a group remaining after removal of either one of the groups $Z_1$, $Z_2$, $R_8$ and $R_9$ of the formula (III) above.

8. A silver halide photographic element according to claim 1, wherein said bidentate ligand is a group remaining after removal of either one of the groups $R_{10}$, $R_{11}$ and $R_{12}$ of the following formula (IV):

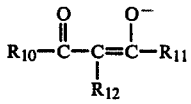

wherein $R_{10}$ and $R_{11}$ are each an alkyl group or an aryl group, and $R_{12}$ is a hydrogen atom, an alkyl group or an aryl group.

9. A silver halide photographic element according to claim 1, wherein said bidentate ligand is a group remaining after removal of either one of the groups $R_{13}$ to $R_{16}$ of the following formula (V):

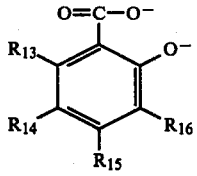

wherein $R_{13}$ or $R_{16}$ are each a hydrogen atom, a halogen atom, a sulfo, cyano, carboxyl, nitro or alkyl group, and $R_{13}$ and $R_{14}$ or $R_{14}$ and $R_{15}$ may form a saturated ring or an unsaturated ring.

10. A silver halide photographic element according to claim 1, wherein said bidentate ligand is selected from among those derived from (N-N) type ligands such as ethylenediamine, 1,2-diaminopropane, N-methylethylenediamine, N,N-dimethylenediamine and N,N'-dimethylethylenediamine; (O-O) type ligands such as acetylacetone, benzoylacetone, maloic acid and salicylic acid; and (N-O) type ligands such as glycine and alanine.

11. A silver halide photographic element according to claim 1, wherein said BALL is large enough to make the Co(III) Complex nondiffusible in the alkali permeable layer of the photographic element.

12. A silver halide photographic element according to claim 1, wherein said PHOTO is selected from among a dye, development restrainer, antifoggant, development accelerator, silver halide solvent, developing agent, toning agent, fixing agent, hardener and precursors of these.

* * * * *